US007007884B2

(12) United States Patent
Beaucher

(10) Patent No.: US 7,007,884 B2
(45) Date of Patent: Mar. 7, 2006

(54) ROLL PAPER FEED DEVICE FOR PRINTING MACHINE

(75) Inventor: Laurent Guy Beaucher, Saint Maur des Fossés (FR)

(73) Assignee: Sagem SA, Paris (FR)

( * ) Notice: Subject to any disclaimer, the term of this patent is extended or adjusted under 35 U.S.C. 154(b) by 300 days.

(21) Appl. No.: 10/724,869

(22) Filed: Dec. 2, 2003

(65) Prior Publication Data

US 2004/0251369 A1 Dec. 16, 2004

(30) Foreign Application Priority Data

Dec. 2, 2002 (FR) ..... 02 15139

(51) Int. Cl.
*B65H 23/06* (2006.01)

(52) U.S. Cl. ..... 242/423; 242/396.9; 242/421.8; 242/595.1

(58) Field of Classification Search ..... 242/396, 242/396.6, 396.9, 421.8, 422, 423, 595, 595.1
See application file for complete search history.

(56) References Cited

U.S. PATENT DOCUMENTS

| | | | | |
|---|---|---|---|---|
| 1,204,011 A | * | 11/1916 | Greene | 242/595.1 |
| 1,469,284 A | * | 10/1923 | Strawin | 242/421.9 |
| 2,757,880 A | * | 8/1956 | De La Motte | 242/595.1 |
| 2,899,145 A | | 8/1959 | Carr | |
| 3,267,827 A | | 8/1966 | Fairbanks | |
| 3,472,463 A | * | 10/1969 | Fedor et al. | 242/595.1 |
| 3,685,761 A | * | 8/1972 | Zelinski | 242/423 |
| 3,792,825 A | * | 2/1974 | Kampf | 242/595 |
| 3,955,772 A | * | 5/1976 | Chisholm et al. | 242/595.1 |
| 3,972,487 A | * | 8/1976 | Costa | 242/595.1 |
| 4,184,647 A | * | 1/1980 | Rourke | 242/423 |
| 4,389,008 A | * | 6/1983 | Boyanowski et al. | 242/595 |
| 4,699,034 A | * | 10/1987 | Sue | 83/649 |
| 5,060,877 A | * | 10/1991 | Bullivant | 242/595.1 |
| 5,174,518 A | * | 12/1992 | Hongo et al. | 242/595.1 |
| 5,279,472 A | * | 1/1994 | Hongo et al. | 242/595 |
| 5,511,744 A | | 4/1996 | Abe et al. | |

FOREIGN PATENT DOCUMENTS

| | | |
|---|---|---|
| EP | 0 452 127 | 10/1991 |
| GB | 737518 | 9/1955 |
| JP | 63-315452 | * 12/1988 |

* cited by examiner

*Primary Examiner*—William A. Rivera
(74) *Attorney, Agent, or Firm*—Stites & Harbison; Douglas E. Jackson

(57) ABSTRACT

1. Roll paper feed device (1) for a printing machine (2), comprising a cradle (3) provided with side cheeks (4), means (5, 7) at the bottom of the cradle for supporting a freely rotating paper roll (6) whenever the free end of the paper web (10) is subjected to a traction (9), braking means (13) for the rotating roll (6), which are joined to the cradle and have at least one elastic bearing member (14) against a side of the roll, which member comprises at least one elastically deformable arm (19) joined to the cradle and a protruding zone (16) situated at the free end of the arm and engaged through an opening (17) in the cheek and protruding relative to the inner face of the latter; the protruding zone is in the form of a protruding stub having a flat bearing surface (18) peripherally surrounded by an inclined surface (24, 25) suitable for sliding over the sides of the roll when this is introduced in the cradle.

10 Claims, 2 Drawing Sheets

FIG.3.
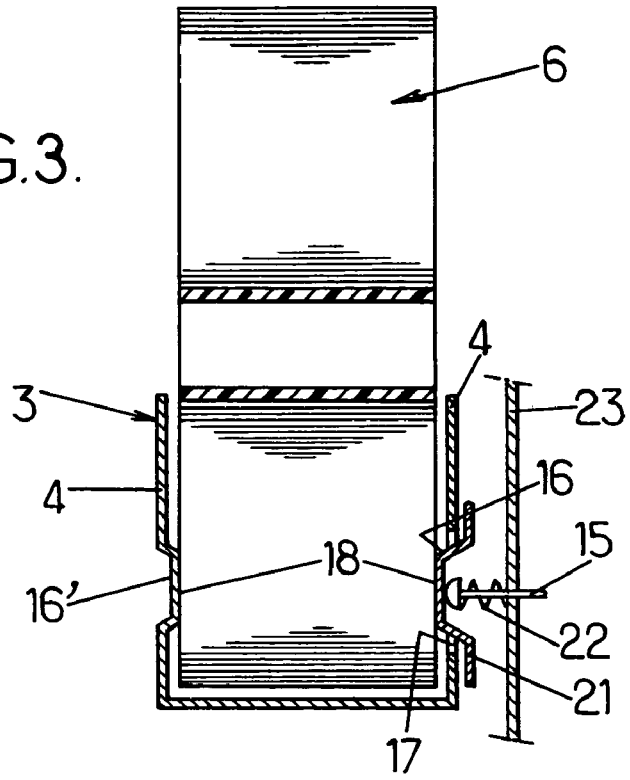
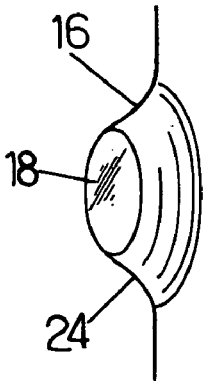
FIG.4
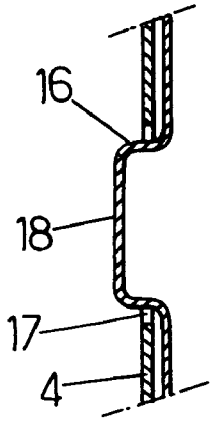
FIG.5.

ROLL PAPER FEED DEVICE FOR PRINTING MACHINE

FIELD OF THE INVENTION

The present invention relates to improvements made in the field of mechanisms for feeding paper in a web, in the form of a roll, in printing machines and, more precisely, it relates to improvements made to roll paper feed devices for a printing machine, comprising a cradle provided with side cheeks, supporting means situated at the lower part of the cradle and forming a cradle for supporting a paper roll such that said paper roll rests freely on said supporting means by its lower periphery and rotates freely on said supporting means whenever the free end of the paper web is subjected to a traction, this device additionally comprising braking means for said rotating roll, which are joined to said cradle and have at least one elastic bearing member against at least one side of the paper roll.

DESCRIPTION OF THE PRIOR ART

Paper feed devices of the type under consideration are appreciated by users by virtue of the ease of loading of a paper roll; there is no member to actuate or displace, there is no shaft to be introduced into bearings, the paper roll is simply deposited on its support at the bottom of the cradle (which generally comprises two idler rollers on which the roll rotates freely).

In certain applications, however, large-capacity paper rolls are used, which have a relatively large diameter (for example, typically in the order of 20 cm) and which are heavy (for example, typically in the order of 2 kg). The result is that a new or largely full roll has a marked inertia when it is set rotating by the printing machine in operation. Now, this roll, resting freely on the idler rollers of the cradle, continues to unwind when the printing machine stops working and the peripheral layers of the roll slacken (unravel). This produces the risk of a premature unwinding of the paper, an entanglement of the paper, a tearing of the paper and even, indeed, a blockage of the feed device.

Document U.S. Pat. No. 2,899,145 describes a roll paper feed device which comprises braking means for the rotating roll, which are arranged to act upon the sides of the roll. However, this known device is designed for printers' paper rolls which are very bulky and therefore very heavy (several tonnes). Hence, the braking means are designed accordingly and are complex. Such means are not suitable for a paper feed device for a printing machine, which device must remain as compact and as simple as possible.

SUMMARY OF THE INVENTION

The object of the invention is to propose improved means aimed at procuring a reliable working of the feed device used in conjunction with a printing machine so as to eliminate the drawbacks presented by current devices, the improvements thus made needing to prove, as far as possible, to be structurally simple and inexpensive, whilst, at the same time, effective.

To these ends, the invention proposes a roll paper feed device for a printing machine, such as mentioned in the introduction, which is characterized, being designed in accordance with the invention, in that said elastic bearing member comprises at least one elastically deformable arm joined to the cradle and at least one protruding zone which is situated at the free end of said arm and which is engaged through an opening made in a side cheek of the cradle and protrudes relative to the inner face of said cheek, and in that said protruding zone is in the form of a protruding stub, which comprises a substantially flat bearing surface suitable for bearing against a side of the roll and peripherally surrounded by an inclined surface suitable for sliding over the sides of the roll when this is introduced in the cradle.

By virtue of the measures of the invention, the desired object is achieved simply and effectively, namely that the paper roll, set rotating by a traction applied to its free end, is permanently braked such that, when the traction force is interrupted, the roll can no longer continue to rotate under its own momentum owing to its inertia and stops instantaneously: the unraveling of the final layers of paper which were evident in previous devices is therefore avoided. The means employed for the braking of the roll are simple and require no adjustment. As is desirable, moreover, the braking force is not excessive, so as not to require too great a traction force on the part of the drive means of the linked printing machine.

In an advantageous embodiment, said inclined face can be substantially truncated in form. Or else, when said bearing stub is only slightly protruding relative to the cheek of the cradle, said inclined surface can be envisaged to be rounded, having a substantially quadrant-shaped cross section.

In order to avoid premature damaging of the braking members in contact with the—cutting—edges of the layers of paper, at least the bearing face of each protruding zone is made of metal, especially of steel.

In a simple solution, said bearing surface can be round in shape.

Preferably, the elastic bearing member of the braking means bears against the side of the roll in the lower part of the latter.

Particularly interestingly, it can also be envisaged that the braking means comprise a second bearing member situated on the other side of the roll and provided with a second, substantially identical protruding zone, which is disposed facing the aforesaid first protruding zone, so as to bear against the other side of the roll. In a preferred embodiment, the second protruding zone can be fixed and joined to a cheek of the cradle. As a variant, however, it may be interesting for the second protruding zone to be situated at a free end of a second elastic arm joined, by its opposite end, to the other cheek of the cradle.

The measures which have just been set out find a most especially interesting application where the cradle is equipped with two idler supporting rollers for the paper roll.

BRIEF DESCRIPTION OF THE DRAWINGS

The invention will be better understood from a reading of the following detailed description of certain preferred embodiments offered solely by way of non-limiting examples. In this description, reference is made to the appended drawings, in which:

FIG. 3 is a sectional view, analogous to that of FIG. 2, of a constructional variant of the device of FIG. 1;

FIG. 4 is a projection of a constituent part of the device of FIGS. 1 to 3; and FIG. 5 is a cross-sectional view of a construction variant of the constituent part of FIG. 4.

DETAILED DESCRIPTION OF THE INVENTION

Figure 1:
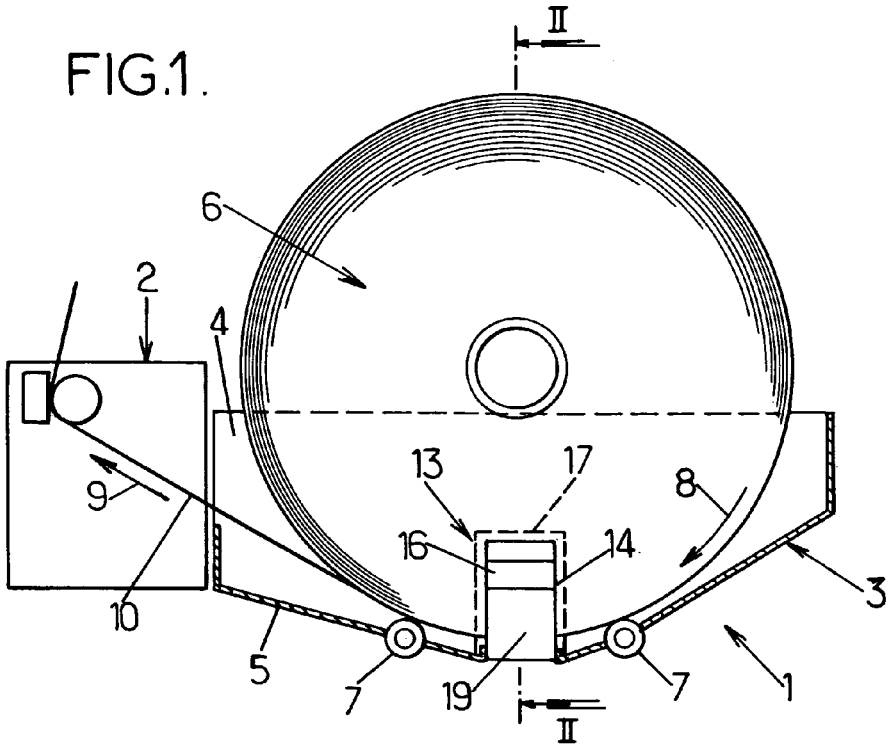
FIG. 1 is a diagrammatic side view, in partial section, of a roll paper feed device arranged according to the invention.

Referring initially to FIG. 1, a roll paper feed device 1 is functionally linked to a printing machine 2.

The feed device 1 comprises a cradle 3 provided with side cheeks 4 (the front cheek, in FIG. 1, has been torn off such that the interior is visible). The bottom 5 of the cradle 3 is arranged in the form of a support or incorporates supporting means for a paper roll 6. In the commonly used arrangement illustrated in FIG. 1, combined with the bottom 5 are two idler rollers 7, which rotate about respective transverse axes (parallel to that of the roll 6), are spaced apart and protrude above the bottom 5, such that the roll 6 is simply placed on the rollers 7 and can rotate freely (arrow 8) when the printing machine 2, in operation, applies a traction (arrow 9) to the paper web 10.

Generally, the cradle 3 is integrated in a housing closed by a lid (not shown).

When the paper roll 6 has a large mass (typically, for example, a roll 20 cm in diameter, weighing in the order of 2 kg), it continues to unwind, by virtue of its inertia, when the traction force ceases to be applied to the web 9 and this results in a loosening of the first roll layers (unraveling).

In order to eliminate this drawback, the roll 6 is combined with braking means 13, supported by the cradle 3, which have at least one member 14 bearing elastically against at least one side of the roll 6.

Both in order to simplify the structure and to ensure that the braking means 13 are active whatever the effective diameter of the roll 6, it is envisaged that the elastic bearing member 14 against the side of the roll is situated facing the lower part of the latter, as illustrated in FIG. 1.

A simple arrangement consists in the elastic bearing member 14 being disposed at the lower part of the bottom 5, between the two rollers 7.

The elastic bearing member 14 applies to the side of the roll a transverse force (arrow 15 in FIG. 2) sufficiently strong to brake the roll when the traction force 9 is interrupted and prevent the final layers of the roll 6 from unraveling, yet sufficiently weak not to disturb the correct rotation of the roll and the correct feeding of the paper web under the action of drive means (in the printing machine), which must not be modified.

The elastic bearing force (diagrammatized by the arrows 15 in FIG. 2) can either result from the constitution of the bearing member 14 or can be imparted by a spring.

As illustrated in FIG. 1, the elastic bearing member 14 comprises a raised zone or protruding zone 16 engaged through an opening 17 made in one of the side cheeks 4 of the cradle 3 and protruding relative to the inner face of said cheek.

Figure 2:
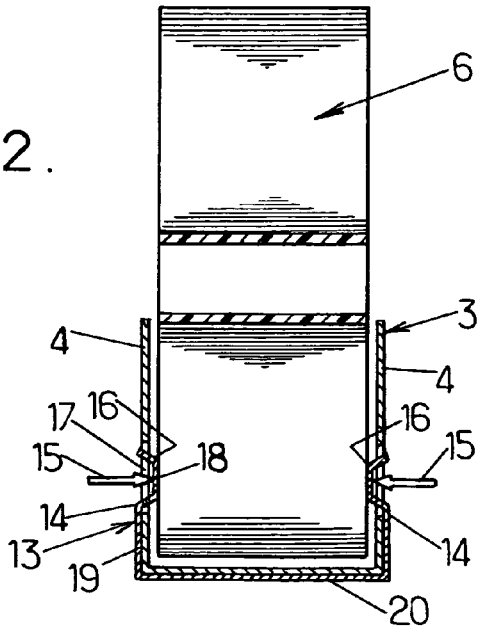
FIG. 2 is a sectional view, along the line II—II of FIG. 1, of the device of FIG. 1.

As illustrated in FIG. 2, this raised zone 16 takes the form of a protruding stub comprising a substantially flat bearing surface 18 suitable for bearing against a side of the roll 6.

In a simple solution, the protruding zone 16 can be situated at one end of a deformable arm 19 joined, at its other end, to the cradle 3.

In order to ensure that the rotation of the roll is not hindered by the braking means, it is preferable for two protruding bearing zones to be applied respectively to the two sides of the roll 6, preferably symmetrically (that is to say that the two protruding zones are disposed approximately facing each other on either side of the roll).

In a preferred embodiment illustrated in FIG. 2, the previously described arrangement is doubled, by providing, on the other side of the cradle, a second protruding bearing zone 16, more particularly it, too, in the form of a protruding stub, which is engaged through an opening 17 provided in the other cheek 4 of the cradle 3 and which is supported by a second deformable arm 19.

In this case, it is interesting that the two arms 19 are joined together by a transverse bar 20, so as to constitute a single piece in the form of a clamp, which is snapped in place onto the cradle 3. A single such piece is easy to make, for example by drop-forging if made entirely of metal or by molding if made of plastics material. In addition, it is quick and easy to fit.

Equally, the assembly of FIG. 3 can be adopted, in which one of the protruding zones, 16', which can also, for its part, advantageously be in the form of a raised stub, is fixed and joined to the cheek 4 of the cradle 3, for example being formed integrally with said cheek 4, as can be seen in FIG. 3 (for example, drop-forged in one piece on the cradle is metal or molded in one piece if the cradle is made of plastics material).

Only one of the protruding zones 16 is in this case displaceable transversely to the cheek 4. This stub 16 can be arranged as indicated previously, by being situated at one end of a deformable arm joined to the cradle.

As a variant, it can also be envisaged that the protruding zone 16 has at its base a holding flange 21, as illustrated in FIG. 3, and that it is held in position solely by a spring 22 bearing against an outer housing 23. It is thus the unit 'protruding zone 16-spring 22' which constitutes the bearing member 14.

In order to facilitate the loading of the roll 6, each protruding bearing zone 16, 16' is arranged in the form of a protruding stub, which comprises a substantially flat bearing surface 18, advantageously round in shape, which is peripherally surrounded by an inclined surface suitable for sliding over the edge of the roll when this is introduced.

An interesting arrangement consists in said inclined surface being substantially truncated, as can be seen in FIGS. 2 and 3 and as illustrated at 24 on a larger scale and in projection in FIG. 4.

However, when the protrusion of the stub is relatively slight on the inner face of the cheek 4 (small clearance between the side of the roll 6 and the cheek 4), it can be envisaged, as illustrated in sectional view in FIG. 4, that the aforesaid inclined surface is constituted by a quadrant-shaped rounded surface 25.

The side of the paper roll 6, formed by the edge of the winding layers of the paper, is particularly aggressive. It is therefore preferable for the bearing surface 18 of each protruding zone 16 to be made out a mechanically high-strength material, preferably metal, especially steel. Should the protruding zone 16 be borne by a deformable arm 19, either it is the unit which can be metal (or even the unit of the single, clap-forming piece), or the metal protruding zone 16 is joined to an arm 19 made of another material, especially a plastics material.

It will be noted that, whatever the envisaged embodiment, each protruding zone 16 is fixed in the direction of rotation of the roll; on the other hand, it is able to accompany low-amplitude transverse motions of the roll (motion along the axis of the roll). More particularly, in the case of the single clamp-like piece illustrated in FIG. 2, this piece can be joined to the cradle 3 so as to be able to shift slightly in the transverse direction relative to the latter.

It will also be noted that, when the braking means comprise two bearing members situated on either side of the roll as indicated above, these bearing members help to maintain the roll in a substantially constant axial position.

The braking means which are thus arranged therefore combine the twin functions of braking and guidance, without any need to resort to other means for the guidance.

What is claimed is:

1. Roll paper feed device for a printing machine, comprising a cradle provided with side cheeks, supporting means situated at the lower part of the cradle and forming a cradle for supporting a paper roll such that said paper roll rests freely on said supporting means by its lower periphery and rotates freely on said supporting means whenever the free end of the paper web is subjected to a traction, this device additionally comprising braking means for said rotating roll, which are joined to said cradle and have at least one elastic bearing member against at least one side of the paper roll, wherein said elastic bearing member comprises at least one elastically deformable arm joined to the cradle and at least one protruding zone which is situated at the free end of said arm and which is engaged through an opening made in a side cheek of the cradle and protrudes relative to the inner face of said cheek, and wherein said protruding zone is in the form of a protruding stub, which comprises a substantially flat bearing surface suitable for bearing against a side of the roll and peripherally surrounded by an inclined surface suitable for sliding over the sides of the roll when this is introduced in the cradle.

2. Paper feed device according to claim 1, wherein said inclined surface is substantially truncated in form.

3. Paper feed device according to claim 1, wherein the bearing stub is only slightly protruding relative to the cheek of the cradle and in that said inclined surface is rounded, having a substantially quadrant-shaped cross section.

4. Paper feed device according to claim 1, wherein said bearing surface is round in shape.

5. Paper feed device according to claim 1, wherein at least the bearing face of the protruding zone is made of metal.

6. Paper feed device according to claim 1, wherein the elastic bearing member of the braking means bears against the side of the roll in the lower part of the latter.

7. Paper feed device according to claim 1, wherein the braking means comprise a second bearing member situated on the other side of the roll and provided with a second, substantially identical protruding zone, which is disposed facing the aforesaid first protruding zone, so as to bear against the other side of the roll.

8. Paper feed device according to claim 7, wherein the second protruding zone is fixed and joined to the other cheek of the cradle.

9. Paper feed device according to claim 7, wherein the second protruding zone is situated at a free end of a second elastic arm joined, by its opposite end, to said other cheek of the cradle.

10. Paper feed device according to claim 1, wherein the supporting means for the paper roll comprise two parallel and mutually spaced rollers.

* * * * *